United States Patent [19]

Bardsley

[11] Patent Number: 4,608,935

[45] Date of Patent: Sep. 2, 1986

[54] TUFTING MACHINE YARN FEED ROLLER ASSEMBLY

[75] Inventor: Harold B. Bardsley, Euxton, near Chorley, England

[73] Assignee: Spencer Wright Industries, Inc., Chattanooga, Tenn.

[21] Appl. No.: 805,867

[22] Filed: Dec. 6, 1985

[30] Foreign Application Priority Data

Jun. 19, 1985 [GB] United Kingdom ..... 8515566

[51] Int. Cl.[4] ..... D05C 15/00

[52] U.S. Cl. ..... 112/79 A

[58] Field of Search ..... 112/79 R, 79 A

[56] References Cited

U.S. PATENT DOCUMENTS

| | | | |
|---|---|---|---|
| 3,847,098 | 11/1974 | Hammel | 112/79 A |
| 3,926,132 | 12/1975 | Lear et al. | 112/79 A |
| 3,955,514 | 5/1976 | Prichard et al. | 112/79 A |
| 4,134,348 | 1/1979 | Scott | 112/79 A |
| 4,193,358 | 3/1980 | Woodcock | 112/79 A |

*Primary Examiner*—Ronald Feldbaum

*Attorney, Agent, or Firm*—Alan Ruderman

[57] ABSTRACT

A yarn feed roller assembly for a tufting machine has a number of sets of rollers about which yarn is adapted to be wound and fed to the needles of the tufting machine. A number of drive shafts each carrying a number of clutches and a like number of feed gears are each driven at a different rotational speed. Each clutch has a first part fixed for rotation with the shaft and a second part rotatably fastened to the corresponding feed gear and axially moveable relative to that feed gear. The feed gear is rotatably mounted on each drive shaft and upon actuation of a particular clutch the feed gear associated therewith is drivingly connected to the shaft for rotation therewith. Respective feed gears of the corresponding shafts are in meshing relationship with one another with a corresponding gear on a respective set of yarn feed rollers so that upon coupling of a particular feed gear to its shaft the yarn feed roller set associated therewith is driven at a speed related to that shaft. Each shaft is formed from a number of assembled shaft sections coupled end to end and readily disassembled therefrom so that upon failure of a particular clutch removal of a shaft section with that clutch thereon can be made without disturbing the yarn on the corresponding feed roller set.

11 Claims, 4 Drawing Figures

TUFTING MACHINE YARN FEED ROLLER ASSEMBLY

BACKGROUND OF THE INVENTION

This invention relates to tufting machines, and more particularly to a drive arrangement for a yarn feed roller pattern assembly having a plurality of feed roller sets, cooperating roller sets being drivingly connected with a selected one of a number of continuously driven shafts for rotating at a respective and different speed, thereby to deliver yarn to the tufting machine in accordance with patterning requirements.

Wide use is made of yarn feed roller pattern attachments or assemblies for producing variations in pile height in tufted pile fabrics such as carpeting. Representative of such feed roller pattern assemblies are those disclosed in the following U.S. Pat. Nos. 2,862,465 to Card; 2,875,714 to Nix; 2,966,866 to Card; 3,001,388 to MacCaffray; 3,075,482 to Card; 3,103,187 to Hammel; 3,134,529 to Beasley; 3,272,163 to Erwin, et al; 3,489,326 to Singleton; 3,605,660 to Short; 3,752,094 to Short; 3,847,098 to Hammel; 3,926,132 to Lear, et al; 3,955,514 to Prichard, et al and 4,134,348 to Scott.

These assemblies include a plurality of yarn feed rollers which feed yarn to the needles of the tufting machine. Each of the feed rollers is selectively driven at one of a plurality of different speeds independently of the other feed rollers by means of clutches controlled by a pattern control. The amount of yarn supplied to the needles of a tufting machine is determined by the rotational speed of the feed rollers about which the yarn is wound, so that with a fixed needle stroke the amount of yarn supplied to each needle determines the pile height of the fabric produced. To create patterned pile effects the amount of yarn fed to the individual needles may be varied by driving the feed rollers selectively at the different speeds.

Early in the development of yarn feed roller pattern assemblies, such as exemplified in Card U.S. Pat. Nos. 2,862,465 and 2,966,866, the feed rollers were mounted in parallel relationship upon respective shafts extending perpendicularly to the row of needles, and each shaft carried a high speed clutch and a low speed clutch. All of the high speed clutches were driven by chain and sprocket mechanisms from a high speed shaft, while all of the low speed clutches were driven by another chain and sprocket mechanism from a low speed shaft, one or the other of the clutches being selectively engaged to couple its drive to the shaft. Later in the development of the prior art, the rollers were separated into upper and lower roll sets with each roll set coupled to a drive shaft, each drive shaft carrying a high speed clutch and a low speed clutch. Again, all the high speed clutches were driven by chain and sprocket mechanisms from a high speed shaft and all the low speed clutches were driven by a chain and sprocket mechanism from a low speed shaft. Actuation of a respective clutch selectively coupled its drive means to the drive shaft to rotate the rolls of each set to the respective high or low speed shaft. Such constuctions are exemplified by Hammel U.S. Pat. Nos. 3,103,187 and Erwin, et al 3,272,163.

The electromagnetic clutch members of the feed roller assemblies wear out or become defective before other parts thereof, and considerable dissassembly of these prior art drive mechanisms had to be carried out before the clutches could be replaced. Such dissassembly and replacement resulted in considerable "down-time" which in many cases was well out of proporation to the seriousness of the fault.

To reduce such "down-time" the prior art developed yarn feed roller assemblies in which the clutch is within the roll. For example, in U.S. Pat. Nos. 3,489,326 to Singleton and 3,926,132 to Lear, et al the clutches were placed within respective rollers. Here two or more drive shafts are driven at different speeds each carrying a number of feed rolls rotatable relative to the respective shafts. Corresponding rolls on each shaft form a roll set which are coupled together so that each set of rolls may rotate at the same speed. The clutches are selectively engaged to couple the roll associated with the engaged clutch to the shaft on which the clutch is mounted for driving that roll and the other rolls in that set from the shaft carrying the engaged clutch. A number of shaft sections were coupled end to end so that a shaft section may be removed for repair or replacement of a defective clutch. However, although highly succesful and effective in reducing "down-time" problems still resulted from the handling of a large number of feed rolls and clutches on a single shaft section. If a clutch in the middle feed roll of a shaft section is defective, then all the remaining feed rolls and clutch members between the defective clutch and the end of the shaft section must be removed before the problem can be remedied. Moreover, since the rolls are removed with the associated clutches, the yarn wound about the rolls is disturbed and when a shaft section is replaced the yarn must again be threadedly wound about the rolls in each roll set associated with the replaced shaft section.

In another effort to reduce the "down-time" a module construction was proposed in Hammel U.S. Pat. No. 3,847,098 wherein each roll set is mounted within a modular housing having a chain and sprocket drive for each roll of the set, with each drive being operable to connect a first shaft on which each roll of the set and its associated internal clutch is mounted to another shaft which carries a gear extending from the module. The latter gears are coupled to a corresponding gear mounted on a shaft in a drive housing when the module is mounted in an operative position. Actuation of one of the clutches within the module couples its roll and by virtue of gearing between the rolls in a set, all the rolls, in the set to the drive and thus the shaft within the drive housing associated therewith. When a clutch must be replaced or repaired, the module including the associated rolls, clutches, chains and sprocket drive is detached and replaced as a unit. Although a more convenient arrangement is provided for changing a worn-out clutch in a module by replacing the entire module, all the rolls, clutches, gears and drive members are removed with the moudle, and the yarn associated with the replaced module must still be pulled away from the original module and then threadedly rewound about the replacement unit, albeit only the yarn associated with that module need be disturbed. Moreover, because of the bulkiness of the modules, they must be mounted in groups spaced vertically apart so as to provide the required number of modules for a tufting machine. This is an inconvenience in servicing the rollers as when the yarn is initially threaded about the various rollers of the yarn feed assembly since it requires working at two different levels, one of which requires a ladder. Furthermore, the size of the rolls are limited by the size of the clutch, as with any yarn feed roller attachment having the clutch within the rolls. This limits the size of the clutch and its associated elements, thereby resulting in faster wearing characteristics since the size of the rolls must be large enough to receive the clutches, the rolls are of a larger size than necessary resulting in the yarn feed attachment being placed high up on the tufting machine, adding to the inconvenience of threading the yarn about the rollers, and of servicing the modules.

SUMMARY OF THE INVENTION

Consequently, it is a primary object of the present invention to provide a clutch actuated yarn feed roller assembly for tufting machines in which the clutch assembly and the rollers are separated one from the other so that the clutch assembly can be serviced, replaced or repaired without disturbing yarn on the rollers, the clutches being mounted in modular sub-assemblies for rapid replacement when necessary.

It is another object of the present invention to provide a yarn feed roller assembly for tufting machines wherein the assembly includes clutches separated from the yarn feed rollers such that maintenance of the clutches can be performed without disturbing yarn wound about the rollers and whereby the size of the rollers are independent of the size of the clutches and vice versa so that the roller assembly may be mounted in a single row for ease of threading yarn about the rollers and larger clutches may be used for better wear characteristics.

It is a further object of the present invention to provide a yarn feed roller assembly for tufting machines including clutch assemblies for selectively coupling respective rollers to selective drive shafts, the clutches and rollers being separately mounted, the clutches being mounted in modular sub-assemblies on shaft sections removeable as a unit from the drive shaft housing, the housing having a pivotably mounted closure lid which when closed may supply electrical energy to the clutches, but which when opened automatically disconnects the electricity for servicing.

Accordingly, the present invention provides a drive arrangement for yarn feed rollers of a tufting machine, the arrangement comprising a plurality of drive shafts, feed gears rotatably mounted on the drive shafts, corresponding yarn feed gears of the shafts being coupled together for unitary motion, a respective selectively operable clutch acting between each yarn feed gear and the shaft upon which the gear is mounted for coupling that gear and the corresponding gears to that drive shaft, and at least one yarn feed roller drivingly connected with respective yarn feed gears for unitary motion therewith at the speed of the selected drive shaft. In the preferred embodiment, the clutch has two elements, a first of which is fast on the respective shaft and the other of which is coupled to a respective gear and selectively moveable into and out of coupling engagement with the first element when actuated so as to couple the gear associated therewith to the shaft, and the yarn feed gears and respective yarn feed roller are drivingly connected together by gear teeth lying in a common plane extending transversely to the drive shaft. Thus, the rollers and respective feed gears and clutches are independently mounted and when a clutch needs servicing the drive shaft on which that clutch is mounted may be readily removed as a unit from the drive and replaced by a like unit without disturbing the rollers and the yarn thereon.

According to a preferred feature of the invention each drive shaft comprises a respective plurality of shaft sections, the shaft sections of a given shaft being arranged and axially aligned in end-to-end disposition and being drivingly connected by cooperating male and female formations. Preferably, a bearing is provided at each respective end of each shaft section and adjacent ends of successive sections are mounted in a bearing cover, there being location means in the cover engagable with the flanks or ends of the bearings for locating the shaft ends in a requisite relative disposition in the axial direction of the shaft.

According to a further feature of the invention, the clutch includes a slip ring at the periphery thereof and further includes at least one feed contact brush engagable with the slip ring, the contact brushes being mounted for pivotable motion about a remote axis to and from a position in engagement with the slip ring. The mounting of the contact brushes are in a plate forming the closure lid for the drive shaft housing so that when closed electricity may flow to the clutches but when the lid is open for service electrical contact is automatically disconnected. Preferably, plural feed contact brushes are provided for each clutch.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
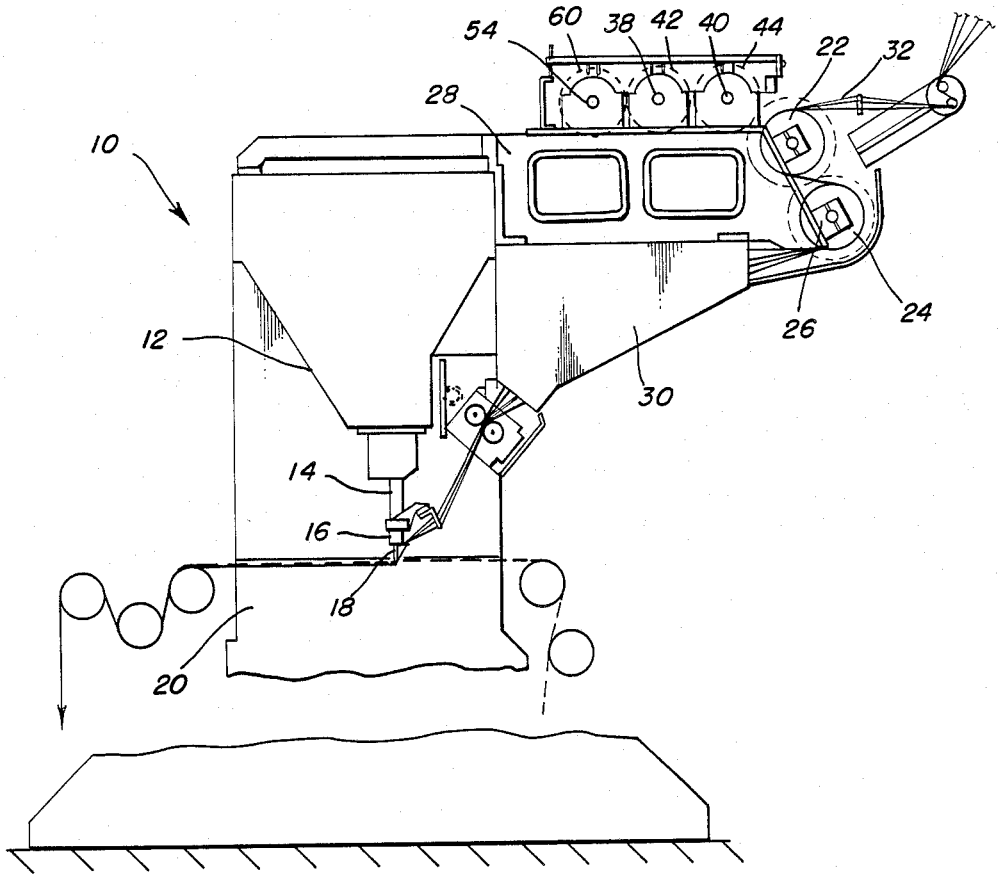
FIG. 1 is a schematic side elevational view of a tufting machine incorporating a yarn feed roller assembly constructed according to the principles of the present invention.

Referring now to the drawings, and particularly to FIG. 1, a tufting machine 10 is illustrated having a head 12 in which a plurality of laterally spaced push rods 14 (only one of which is illustrated) is reciprocably mounted, the push rods carrying a needle bar 16 at the lower end thereof for supporting needles 18 which cooperate in conventional manner with loopers or hooks (not illustrated) in the bed 20 of the machine. A single row of a multiplicity of respective pairs or sets of yarn feed rollers 22, 24 are rotatably supported in cantilever fashion on shaft members 222, 224 respectively and in side-by-side disposition at the front of the machine on a support bracket 26 carried by a frame 28 mounted on the head 12. Because of the construction of the feed roller assembly the frame which supports the entire assembly may be disposed directly above the tube bank 30 through which the strands of yarn 32 are fed. The yarn 32 is fed to the rollers 22, 24 from a creel (not shown) and is guided to the individual needles 18 of the tuft forming instrumentalities through the tube bank 30 to direct the yarn from the feed roller sets to the desired needle as required.

The individual rollers of each respective set of yarn feed rollers 22, 24 which define the feed roller means, are drivingly connected together at an end thereof by the intermeshing of ring gears 34, 36 respectively provided thereon so that the rolls of a set are driven together at the same speed. The rollers 22, 24 are driven at a selected one of the respective speeds of at least two drive shafts 38, 40 through yarn feed gears 42, 44 freely mounted on the respective shafts 38, 40. The feed gears 42, 44 are in mesh with each other and with a ring gear 34 associated with each roller 22. The yarn feed gears 42, 44 are selectively engagable with the respective drive shaft 38, 40 by means of electromagnetic clutches 50, 52 operating between the respective feed gears 42, 44 and the drive shafts 38, 40 in which they are mounted.

The clutches 50, 52 may be selectively operated in accordance with patterning requirements drivingly to connect rollers 22, 24 with either the drive shaft 38 or the drive shaft 40 thereby to deliver yarn to the needles 18 at a rate determined by the speed of the corresponding roller set.

It will be appreciated that by separating the clutches 50, 52 from the yarn feed rollers 22, 24 and by providing a direct gear connection between the yarn feed gears 42, 44 and the respective rollers 22, 24, removal of the drive shafts 38, 40 and the clutches 50, 52 mounted thereon can be effected without the need to disturb the yarn feed rollers 22, 24 and the yarn 32 wound thereon.

The arrangement thus far described provides for two rates of yarn feed, corresponding to the respective speeds of the drive shafts 38, 40. By including a third drive shaft 54 having respective clutches 58 and feed gears 60 thereon, the feed gears 60 being in mesh with corresponding feed gears 42, and drive shaft 54 being driven at a speed different from that of either of shafts 38, 40, three rates of feed can be provided. The shafts 38, 40 and 54 may be driven at the three rates in conventional manner at one end thereof by drive means (not illustrated) driven in timed relationship to that of the reciprocation of the needle bar 16, the relationship being established by the main shaft (not illustrated) which is journalled in the head 12 of the machine.

By providing the individual drive shafts 38, 40, 54 together with the respective clutches 50, 52, 58 and respective feed gears 42, 44, 60 mounted thereon, in modular form, removal and replacement of a clutch in the event of failure can be effected with minimal machine down time and, as has previously been mentioned, without any disturbance of the yarn feed rollers 22, 24 and the yarns thereon.

In order further to facilitate removal and replacement of a module, the present invention also proposes a quick release drive arrangement connecting successive sections of the individual drive shafts 38, 40, 54 and also the separation of the electrical feed to the clutches 50, 52, 58 mounted on the drive shaft sections.

Figure 4:
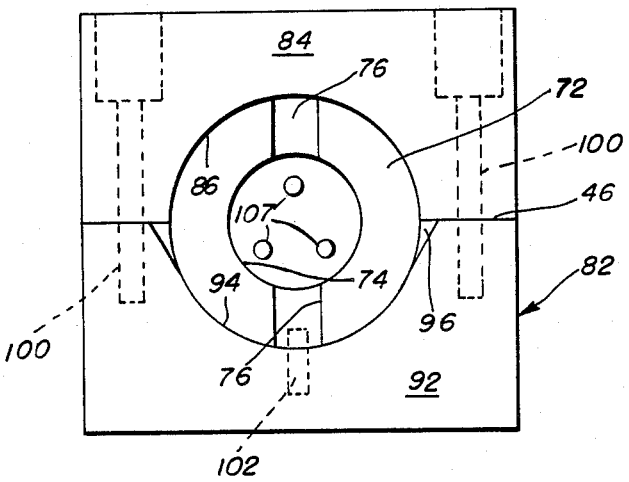
FIG. 4 is an end elevational view showing the mounting of a clutch shaft sub-assembly.
Figure 2:
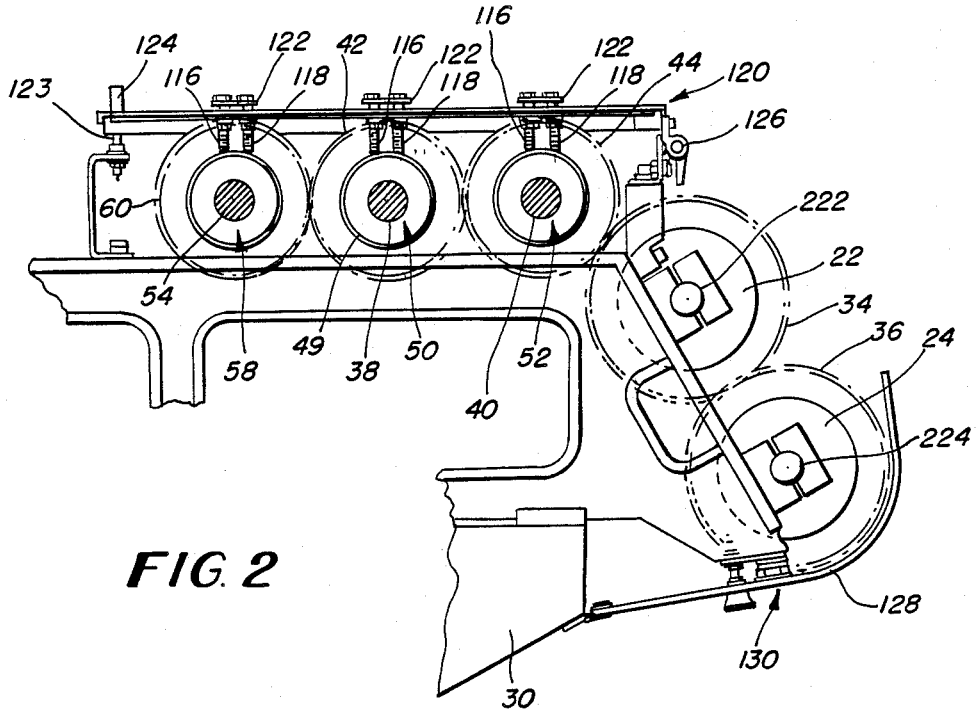
FIG. 2 is a diagrammatic side elevational view of the yarn feed roller assembly illustrated in FIG. 1 but at an enlarged scale.
Figure 3:
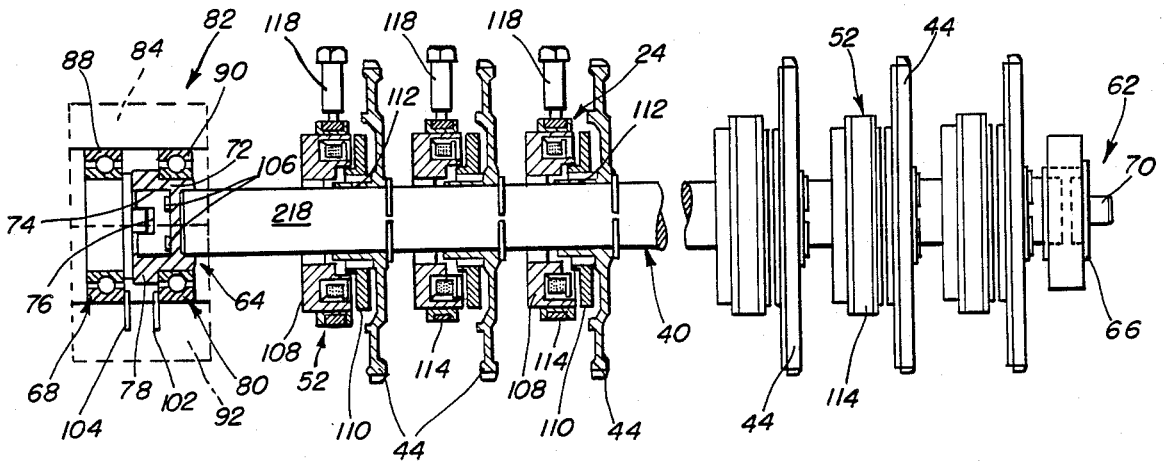
FIG. 3 is an elevational view of a portion of one of the yarn feed roller assembly drive constuctions shown partly in section.

Thus, referring now to FIGS. 2 through 4, each drive shaft 38, 40, 54 comprises a pluarlity of shaft sections 218, illustrated in FIG. 3 with regard to the shaft 40, each shaft section having a length determined by requirements, the opposite ends of each shaft section being provided with cooperable male and female coupling means 62, 64 respectively, for engagement with the complimentary coupling means of an aligned and adjacent shaft section 218. In practice, it appears that each shaft section will carry approximately 10 clutches and speed gear assemblies. The male coupling means 62 comprises a flanged cap 66 engaged with a respective end of the shaft section and supporting a bearing 68 thereon, there being a narrow bar 70 extending diametrically of the flanged outer end of the cap 66. The female coupling means 64 comprises a cap 72 engaged with the end of the shaft section 218, cap 72 having a blind bore 74 at its outer end and there being two diametrically opposed slots 76 in the wall 78 defined by the bore 74. The slots 76 constitute a female formation and are sized and dimensioned to receive the bar 70 of an adjacent shaft section into coupling engagement therewith. The female coupling means 64 also includes a bearing 80 supported on a reduced portion thereof.

The connection between two successive shaft sections 218 is supported in a bearing cover 82 which serves also axially to locate the sections, the bearing cover 82 being shown in FIG. 4 and, in part, at the left hand end of FIG. 3. The bearing cover 82 comprises an upper part 84 having a recess 86 therein of semi-circular form dimensioned to receive the outer bearing races 88, 90 of the bearings 68, 80 respectively and a lower part 92 having a recess 94 generally of semi-circular form, the recess 94 being enlarged at 96 adjacent the mating face 98 of the lower part to facilitate engagement with the respective bearings 68, 80. The upper and lower part 84, 92 are secured together by bolts 100. The lower part 92 of each bearing cover further includes two locating pins 102, 104 engagable with the adjacent flanks or sides of the outer bearing races 88, 90 of the resepective bearings 68, 80, thereby to locate the bearings 68, 80 in a predetermined relative disposition. Correct angular alignment of the shaft sections 218 on assembly of the shaft from the separate sections thereof, is ensured by providing a three screw fixing of the end caps 66, 72 on the shaft ends, such fixing providing a reference for determining the angular disposition of the shaft relative to the cooperable male and female formations. For example, screws such as 106 connect the end caps and the corresponding end of the shaft section, the screws 106 being disposed in an offset relationship such as illustrated at 107 in FIG. 4.

To reduce bearing wear, the clutches 50, 52 and 58 are of the rotary field type wherein the rotary field 108 is keyed to the shaft section 218 and the armature 110 is slidably splined on the hub 112 of the respective feed gear 42, 44, 60. When the clutch is actuated the armature is pulled toward the field by the electromagnetic force and couples the corresponding feed gear to the clutch and thus the shaft section to drive the feed gear at the speed of that shaft. Electrical feed to the clutches 50, 52, 58 is through respective slip rings 114, and the clutches are grounded through the respective shafts 38, 40 and 54. The feed contacts 116, 118 which carry the brushes that contact the slip rings to supply current for the clutches, are supported in a hinged lid 120, as illustrated in FIG. 2, which overlies the shafts and closes the top of the housing which they are mounted, related contacts 116, 118 being electrically connected through respective connector plates 122 such that on failure of one of a related pair of contacts the other contact of that pair remains operative. The lid 120 is held in the closed condition by a ball catch 123, and a handle 124 is provided to facilitate opening and closing of the lid which is pivotable about the hinge 126. As will be appreciated, a requisite number of feed contacts can be provided in appropriate disposition in the lid, being electrically insulated from the lid, and can be brought into operative relationship with the individual clutches on closure of the lid and can be readily disengaged permitting service of the sub-assembly of clutches, gears and shafts.

Inspection of the feed contacts can be effected and any worn or damaged contacts replaced in a readily simple manner. When a clutch is defective or worn so as to require replacement, the lid 120 is opened, the required modular shaft section 218 is removed by dissassembling the bearing covers 82 at each end of the shaft section 218. A new modular shaft section 218 is then installed, the bearing cover 82 reassembled, the lid 120 closed and the machine is again operative.

A guard 128 may be provided at the front of the yarn feed rollers 22, 24, the guard 128 being hingedly mounted on the tube bank 30 and being held in an operative position by ball catch means 130.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A yarn feed roller assembly for a tufting machine comprising a plurality of sets of rollers about which yarn is adapted to be wound and fed, a plurality of rotatably mounted drive shafts each adapted to be driven at a different speed, a feed gear rotatably mounted on each drive shaft, corresponding feed gears of the respective shafts being in meshing relationship and defining a gear set, each gear set corresponding to each set of rollers, a selectively operable clutch corresponding to each feed gear, each clutch having a first part fixed on the respective drive shaft for rotation therewith, and a second part rotatably fastened to the corresponding feed gear and axially moveable relative to the respective drive shaft toward and away from said first part, whereby selective actuation of a clutch couples the corresponding feed gear to the respective drive shaft for rotation therewith and each gear of a gear set is driven at a speed determined by the speed of the drive shaft carrying the actuated clutch, and gear means associated with each set of rollers disposed in meshing relationship with a corresponding feed gear of the respective gear set for driving each roller set at a speed determined by the speed of the corresponding gear set.

2. A yarn feed roller assembly as recited in claim 1, wherein each drive shaft comprises a plurality of shaft sections, each section having a male formation at one end and a female formation at the other end for coupling adjacent shaft sections in end-to-end disposition.

3. A yarn feed roller assembly as recited in claim 2, wherein each shaft section is supported by a bearing, and adjacent ends of successive sections are mounted within a bearing cover, said cover having locating means for axially locating the ends of the respective shafts.

4. A yarn feed roller assembly as recited in claim 2, wherein each shaft section supports a plurality of feed gears and corresponding clutches, the shaft section together with the associated feed gears and clutches defining a module, each module being independently moveable from adjacent modules of said assembly.

5. A yarn feed roller assembly as recited in claim 4, wherein each shaft section is supported by a bearing, and adjacent ends of successive sections are mounted within a bearing cover, said cover having locating means for axially locating the ends of the respective shafts, said cover comprising at least a pair of members readily dissassembled for permitting removal of a module.

6. A yarn feed roller assembly as recited in claim 1, wherein said first part of each clutch carries a slip ring rotatable therewith, at least one contact brush associated with each slip ring for transmitting electrical signals to said clutch, and means for pivotably mounting a plurality of said brushes for movement into and out of operative engagement selectively with the corresponding slip ring.

7. A yarn feed roller assembly as recited in claim 6, wherein each drive shaft comprises a plurality of shaft sections, each section having a male formation at one end and a female formation at the other end for coupling adjacent shaft sections in end-to-end disposition.

8. A yarn feed roller assembly as recited in claim 7, wherein each shaft section is supported by a bearing, and adjacent ends of successive sections are mounted within a bearing cover, said cover having locating means for axially locating the ends of the respective shafts.

9. A yarn feed roller assembly as recited in claim 7, wherein each shaft section supports a plurality of feed gears and corresponding clutches, the shaft section together with the associated feed gears and clutches defining a module, each module being independently moveable from adjacent modules of said assembly, the brushes corresponding to the clutches of a module being mounted on a common member.

10. A yarn feed roller assembly as recited in claim 9, wherein said member comprises a lid overlying the shaft section of respective gear sets, whereby pivotable movement of said lid disconnects electricity from all the clutches corresponding to the module in the gear sets associated with said lid.

11. A yarn feed roller assembly as recited in claim 1, wherein all the sets of rollers lie in a single row such that yarn strands wound on the respective set of rollers are disposed in substantial alignment.

* * * * *